US008923485B2

(12) United States Patent
Kraft et al.

(10) Patent No.: US 8,923,485 B2
(45) Date of Patent: Dec. 30, 2014

(54) ANODE DISK ELEMENT COMPRISING A HEAT DISSIPATING ELEMENT

(75) Inventors: Kevin Kraft, Plainfield, IL (US); Gerald J. Carlson, Aurora, IL (US); Paul Xu, Oswego, IL (US)

(73) Assignee: Koninklijke Philips N.V., Eindhoven (NL)

( * ) Notice: Subject to any disclaimer, the term of this patent is extended or adjusted under 35 U.S.C. 154(b) by 401 days.

(21) Appl. No.: 13/378,845

(22) PCT Filed: Jun. 24, 2010

(86) PCT No.: PCT/IB2010/052893

§ 371 (c)(1),
(2), (4) Date: Jan. 11, 2012

(87) PCT Pub. No.: WO2011/001343

PCT Pub. Date: Jan. 6, 2011

(65) Prior Publication Data

US 2012/0099703 A1 Apr. 26, 2012

Related U.S. Application Data

(60) Provisional application No. 61/221,181, filed on Jun. 29, 2009.

(51) Int. Cl.

| | |
|---|---|
| ***H01J 35/08*** | (2006.01) |
| ***H01J 35/10*** | (2006.01) |
| ***H01J 35/12*** | (2006.01) |

(52) U.S. Cl.

CPC ..... *H01J 35/105* (2013.01); *H01J 2235/1291* (2013.01); *H01J 2235/1204* (2013.01); *H01J 2235/081* (2013.01)

USPC ..... 378/129; 378/143; 378/144

(58) Field of Classification Search

USPC ..... 378/119, 121, 125, 127–129, 141–144

See application file for complete search history.

(56) References Cited

U.S. PATENT DOCUMENTS

| | | | | |
|---|---|---|---|---|
| 4,847,883 | A * | 7/1989 | Fourre | 378/144 |
| 5,825,848 | A | 10/1998 | Virshup et al. | |
| 5,875,228 | A * | 2/1999 | Truszkowska | 378/144 |
| 5,943,389 | A * | 8/1999 | Lee | 378/144 |
| 6,554,179 | B2 | 4/2003 | Horner et al. | |
| 6,940,946 | B2 | 9/2005 | Kutschera | |
| 7,313,226 | B1 * | 12/2007 | Falce et al. | 378/143 |
| 8,553,844 | B2 * | 10/2013 | Lewalter et al. | 378/127 |
| 2004/0013234 | A1 | 1/2004 | Kutschera | |
| 2007/0064874 | A1 | 3/2007 | Lenz | |
| 2008/0043921 | A1 | 2/2008 | Freudenberger et al. | |
| 2008/0260102 | A1 * | 10/2008 | Steinlage et al. | 378/143 |
| 2011/0129068 | A1 * | 6/2011 | Lewalter et al. | 378/127 |

FOREIGN PATENT DOCUMENTS

DE 102006038417 A1 2/2008

* cited by examiner

*Primary Examiner* — Anastasia Midkiff

(57) ABSTRACT

An anode disk element for the generation of X-rays that provides improved dissipation of heat from a focal track includes an anisotropic thermal conductivity. The anode disk element includes a focal track and at least one heat dissipating element. The anode disk element is rotatable about a rotational axis with the focal track being rotationally symmetrical to the rotational axis. The at least one heat dissipating element is configured for heat dissipation from the focal track in the direction of reduced thermal conductivity of the anode disk element.

12 Claims, 9 Drawing Sheets

ANODE DISK ELEMENT COMPRISING A HEAT DISSIPATING ELEMENT

TECHNICAL FIELD OF THE INVENTION

The present invention relates to X-ray tube technology in general.

More particularly, the present invention relates to an anode disk element for an X-ray generating device, comprising a heat dissipating element, to an X-ray generating device, to an X-ray system, to the method of manufacturing an anode disk element and to the use of an anode disk element in at least one of an X-ray generating device, an X-ray tube and an X-ray system.

BACKGROUND OF THE INVENTION

X-ray generating devices, also known as for example X-ray tubes, may be employed for the generation of electromagnetic radiation used e.g. for medical imaging applications, inspection imaging applications or security imaging applications.

An X-ray generating device may comprise a cathode element and an anode element between which elements electrons are accelerated for the production of X-radiation. The electrons travel from the cathode element to the anode element and arrive at the anode element at an area called the focal spot, so creating electromagnetic radiation by electron bombardment of the anode element. Anode elements may be of a static nature or may be implemented as rotating anode elements.

Since most of the energy applied to the focal spot via electron bombardment is converted to heat, the generation of electromagnetic radiation may be considered to be quite inefficient. One of the central limitations of X-ray tubes is the cooling, thus the dissipation of heat, of the anode element, in particular the focal track.

With a rotating anode element, the focal spot is distributed over a larger radial area of the anode element by rotating the anode element underneath the focal spot, thus creating a focal track. Accordingly, the heat load acting on the anode element is distributed over a larger circular area thus increasing the possible power rating of the X-ray generating device.

SUMMARY OF THE INVENTION

There may be a need to provide an anode disk element that may sustain increased heat while still maintaining structural integrity. Furthermore, there may be a need for improved dissipation of heat from the focal track, in particular the focal spot area.

The anode elements of X-ray tubes may comprise refractory metal targets. Refractory metal provides many favorable properties in the field of electromagnetic radiation generation, like e.g. high temperature resistance, high strength, thermal conductivity and high heat capacity.

However, when rotating anode disk elements, the substantial number of rotations per minute (RPM) benefits the occurrence of significant mechanical stresses in an anode disk element. Also, during the process of X-ray generation, the heating of the anode element facilitates the occurrence of thermal mechanical stresses.

A significant amount of energy applied to the focal spot by electron bombardment is transformed into heat. Since the temperature of the anode disk element may be considered to be the limiting factor of an X-ray tube, the heat of the focal spot has to be managed, e.g. by removing heat from the area of the focal spot or focal track.

The localized heating of the focal spot due to impingement of electrons may be considered to be a function taking into account parameters like target angle, focal track diameter, focal spot size (length×width), rotating frequency, power applied to the focal spot and material properties such as thermal conductivity, density and specific heat of the anode disk element.

In the following, an anode disk element for an X-ray generating device, an X-ray generating device, an X-ray system, a method of manufacturing an anode disk element and the use of an anode disk element in at least one of an X-ray generating device, an X-ray tube and an X-ray system according to the independent claims are provided.

Further preferred exemplary embodiments may be derived from the dependent claims.

The anode disk element may be provided with a composite material and/or a material comprising an anisotropic thermal conductivity.

A composite material may be a material combination being composed by at least two distinct structures or materials, e.g. a fiber and a matrix.

A material with an anisotropic thermal conductivity may be seen as a material having a first thermal conductivity in a first direction of the material, while having at least a second thermal conductivity in a second direction, with the first thermal conductivity and the second thermal conductivity being unequal. E.g., a material may comprise a first thermal conductivity in a first direction, said first thermal conductivity being higher than a second thermal conductivity in a second direction. In other words, in this example, the second thermal conductivity is decreased or reduced compared to the first thermal conductivity.

Certain types of composite materials may exhibit an anisotropic thermal conductivity, in particular depending on the arrangement of the individual, distinct structures or materials, e.g. the fiber material, within the composite. The individual materials may remain distinguishable even in the composed material.

It may also be conceivable, that non-composite materials as well exhibit an anisotropic thermal conductivity.

Non-composite material may also be referred to as monolithic material or homogenous material. In particular, a non-composite material may be considered to not be constituted of two or more separate dedicated materials or material structures but rather be composed of a homogenous material, in particular having a homogenous material distribution and/or material structure.

The gist of the invention may be seen as providing a heat dissipating element, that provides a preferred heat dissipation or an enhanced heat dissipation in a certain direction of an anode disk element.

The heat dissipating element may provide a thermal conductivity in a direction of the anode disk element, in particular the material of the anode disk element that has a reduced thermal conductivity when compared to a further direction of the anode disk element with a further thermal conductivity. In particular, the heat dissipating element may provide a thermal conductivity or heat transfer capacity that is higher than the thermal conductivity of the anode disk element, in particular in a certain section or direction, e.g. the direction of extension of the heat conducting element, of the anode disk element.

In other words, the heat conductive element provides a path for heat conduction, thus dissipation of heat, inside of the anode disk element, that may in particular be increased compared to the heat dissipation capacity of the anode disk element itself.

The heat conductive element may also be seen as an element for a controlled or directed conduction of heat.

Thus, the heat conductive element may be adapted for heat dissipation from the focal track in the direction of a reduced thermal conductivity of the anode disk element.

An aspect of the present invention is to provide an anode disk element made of a composite material, in particular comprising a matrix structure. A composite material may employ a fiber material in conjunction with a matrix material, which matrix material may in particular encompass the fiber material, to constitute the matrix structure.

The fiber material may be a non-directional or omni-directional fiber material or may comprise a defined fiber structure, in particular a woven fiber structure. For example, the use of a composite structure of a carbon fiber reinforced with a carbon matrix material may allow to provide an anode disk element with improved mechanical strength.

The fiber material may be woven in a polar configuration, for example providing true radial and circumferential fibers, thus creating rotational symmetry by optimizing hoop and radial mechanical properties to preferably adapt the construction of the anode disk element to occurring stresses during rotation.

A polar configuration, in particular a rotationally symmetrical polar configuration, may be understood as being composed by two separate fiber structures. One fiber structure may be substantially protruding outwards from the axis of rotation, thus being perpendicularly aligned to the rotational axis of the rotating anode disk element. The second fiber structure may be considered to be aligned equidistant from the rotational axis with regard to a respective fiber, thus being aligned circumferentially to the rotational axis of the anode disk element. At the point of intersection of the two fiber structures, the fibers may be considered to be substantially perpendicular to one another.

While an according weave configuration is considered to be rotationally symmetrical, it is to be understood that due to the structure of weaving fibers, an optimal or true rotationally symmetrical construction may not be achievable, in particular, a continuous rotational symmetry. However, even a sectional rotational symmetry is to be considered a rotational symmetry in the context of the present patent application.

An according fiber structure may provide good thermal conductivity along individual fibers, however may provide reduced thermal conductivity in the cross-ply direction, i.e. the direction between individual fiber layers, due to the absence of fibers connecting individual fiber layers and the majority of fibers being oriented in an in-plane direction.

The in-plane orientation of the fiber structure may provide enhanced stability, providing a preferred removal of localized heat from the focal track in an in-plane direction along the fiber structure while providing reduced removal of localized heat in a cross-ply direction.

The present invention also relates to the application or incorporation of a heat dissipating element into the structure of the composite material. In particular it relates to the incorporation, e.g. by weaving or pinning, of heat conducting fibers into the composite material.

The heat conducting fiber may be a weaved high temperature, high thermal conductivity fiber that is incorporated into the composite material, for example carbon fiber reinforced carbon (CFC) material, constituting an anode disk element of an X-ray generating device, in particular a rotating X-ray tube anode element of an X-ray tube.

An according anode disk element may in particular have metal fibers incorporated as heat dissipating element, e.g. made of a refractory metal like for example tungsten (W), rhenium (Re), niobium (Nb), molybdenum (Mo), tantalum (Ta), hafnium (Hf) or their respective alloys. Refractory metals are a class of metals that are extraordinarily resistant to heat and wear.

The heat dissipating element may be arranged substantially parallel to the rotating axis of the anode disk element, being oriented in axial direction or cross-ply direction to provide a heat conductivity path between individual fiber layers, in particular by providing a fiber connection between fibers of individual, separate fiber layers, which fiber layers are situated adjacent to one another, however being spaced apart, thus being prevented from fiber to fiber contact of the individual layers, by the matrix material in axial direction.

An according heat dissipating element or thermal conductivity fiber may improve cross-ply thermal conductivity or interlaminar thermal conductivity, in particular in axial direction. This may further be enhanced by arranging the fibers substantially in the area or rather under the focal track of the anode disk element.

Furthermore, such heat dissipating elements may improve the adhesion of a focal track that is being provided on the anode disk element for example by chemical vapor deposition (CVD). Also, by placing heat dissipating elements in the area of the focal track, under the focal track and/or rather at the surface of the focal track, the focal track itself may so be created. Thus, an additional or separate chemical vapor deposition or vacuum plasma spraying (VPS) of the focal spot may not be required any more.

By incorporating separate heat dissipating elements, a machinable mass on the backside of the target or anode disk element, the side opposite of the surface of the focal track, may be created that may be employed for balancing purposes, in particular dynamic balancing purposes.

An anode disk element according to the present invention, in particular a CFC anode disk element, may be manufactured with heat dissipating elements like e.g. refractory metal fibers being weaved into the pre-form structure or being pinned into the pre-form structure.

Weaving may be considered to weave carbon fibers similarly to textile binding.

Pinning may be understood as inserting the heat dissipating element by providing an external force, thus driving the heat dissipating element into the fiber material of the pre-form composite material structure.

The heat dissipating element may penetrate in between the weaved structure of the composite material thus achieving contact with the fibers of individual fiber layers and consequently providing a thermal conductivity path between otherwise spaced apart fiber layers. A respective incorporation of a heat dissipating element or metal fibers may provide improved laminar properties of the pre-form structure in axial direction by providing an additional heat conducting path.

Pinning, a.k.a. as needling, may also be understood as the process of adding, in particular manually adding, cross-ply fibers to the pre-form to provide improved interlaminar properties like e.g. improved heat conductivity.

Once the pre-form is complete with a desired weave, the pre-form may be densified via a compression process, pyrolytic carbon impregnation (PCI) or chemical vapor infiltration (CVI) to complete the matrix around the fibers.

Refractory metal fibers may be added to a carbon fiber polar woven structure pre-form. The polar weave provides true radial and circumferential fibers to optimize hoop and radial properties, in particular rotational symmetry. Also, the refractory metal fibers may be woven into the fiber structure, pinned into the pre-form fiber structure or also completed structure in the area of the focal track. This assembly or incorporation may take place prior to densification of the fiber structure.

As a heat dissipating element in the context of the present invention, any element may be understood or employed that may be suitable to improve interlaminar heat conduction by providing a heat dissipating path or heat conducting path between individual fiber layers, thus providing an interlaminar heat conducting or heat dissipating path. A heat dissipating element may also be referred to as a heat conductive element or conductive element. Interlaminar heat conduction may in particular be understood as a heat conduction in a direction in which a material with an anisotropic heat conductivity comprises a reduced heat conductivity. Thus, an actual crossing of a physical layer, in particular a laminar layer, may not be required but may be preferred.

The heat conductive element may be substantially an elongated element and may be understood as an element that is at least extending or spanning substantially in one preferred, predefined direction, in particular being continuous, with the other two dimensions being possibly neglectable. An according element may comprise a pin-shape, nail-shape or a fiber element having a continuous predefined extension in substantially only one direction.

The extension is to be sufficient to bridge or cross different layers of the fiber structure for providing a heat conducting path between fiber layers. However, also an element having a substantial extension in two dimensions, having for example a sword-shape, saw-shape or comb-shape is conceivable.

In other words, the elongation, extension, range or span of the heat dissipating element is to be sufficient for heat dissipation or conduction between two or more fiber layers of a fiber structure, which would otherwise have no or poor thermal conductivity.

The heat conducting element may also be understood as an aggregation of individual elements, e.g. metal particles. E.g., in the case of a composite structure, metal particles may be incorporated into the structure of the anode disk element, in particular in its anisotropic thermal structure, for enhancing a thermal conductivity in a direction of reduced thermal conductivity of the anode disk elements' material.

A metal infusion heat conducting element may also be understood as an elongated element, in this case possibly comprising the overall metal infused structure as constituting the elongated element. Also, the individual metal particles or metal elements employed for metal infusion may be seen as constituting individual elongated elements.

This metal infusion may create a metal structure within the disk elements' material, e.g. a CFC matrix, to improve cross-ply thermal properties. This may create a conductive path for the localized heating from the electron bombardment of the focal track to distribute throughout the anode. The metal infusion may be designed to be added at the focal track and/or throughout the whole target or anode disk element.

The metal infusion may be located under the focal track and may enhance cross-ply thermal conductivity, may improve adhesion of a focal track provided e.g. by chemical vapor deposition (CVD) and may even create the focal track itself with no additional chemical vapor deposition (CVD), vacuum plasma spraying (VPS) or the like.

Also, with metal infusion, the target may have a machinable mass on a specified surface of the anode disk element for dynamic balancing purposes.

In case of a CFC anode disk element, the anode may be manufactured by creating a pre-formed polar woven carbon fiber structure. The polar weave may be provided with radial and circumferential fibers to optimize hoop and radial properties, in particular having rotational symmetry. Once completed, this structure may be densified through a compression process and/or pyrolytic carbon impregnation. Once a desired structure and density is obtained, the CFC anode may be metal infused. This process may include melting the desired metal and/or alloy and infusing it within the CFC matrix. The infusion process may be located directly under and/or on the focal track area or throughout the entire anode CFC matrix structure. Additionally, the method of metal infusion may include a method of chemical vapor infiltration (CVI).

It is also conceivable to employ a substantially circular element in place of or as the focal track. An according circular element may have at least one protrusion, which is comparable to any of the above-mentioned shapes for a heat conductive element, protruding from a surface of the circular element for insertion or incorporation into the fiber structure, thus subsequently the anode disk element. The circular element may be provided of a material suitable for arranging on the focal track or even of a material suitable for a focal track, e.g. a refractory metal, an alloy and in particular tungsten rhenium or dentrite rhenium.

The present invention may in particular be employed with anode disk elements employing a carbon matrix composite or ceramic matrix composite. X-ray tubes employing according anode disk elements may be considered as high performance products suited in particular for cardiovascular and CT medical imaging. However, according X-ray tubes may also be employed for inspection and security applications.

The pre-form may be completed similarly to textile creation. Once the pre-form is completed with the desired weave, the pre-form is densified via a compression process, e.g. by pressing. However, the CFC target may still be very porous and non-continuous. The densification may be completed by pyrolytic carbon impregnation (PCI) or chemical vapor infiltration (CVI) to complete the matrix around the fibers.

X-ray tubes may be designed either unipolar or bipolar.

Bipolar X-ray tubes employ a cathode element and an anode element, with a negative potential, e.g. −70 kV, at the cathode element and a positive potential, e.g. +70 kV, at the anode element.

Unipolar X-ray tubes may be considered to be an end grounded platform. An according unipolar X-ray tube may still employ a cathode element for accelerating electrons to an anode element having ground potential. Thus, a unipolar X-ray tube may comprise a cathode element having e.g. a potential of −140 kV, while the anode element or CFC target has e.g. zero potential. The anode element may in particular not comprise a positive potential.

Generally speaking, an electric potential is arranged between a cathode element and an anode element for the acceleration of electrons from the cathode element to the anode element. A cathode element may be understood as an electron emitting element while an anode element may be considered to be an electron receiving or electron collecting element.

CFC anodes may be considered to comprise improved characteristics, for example, for the purpose of high-end, high-power, fast rotation speed, and large power density CT systems. As the power demand increases and the focal spot size decreases, CFC anode elements provide advantages in dealing with mechanical and thermal-mechanical stresses, as well as withstanding and dealing with the thermal loads of high-end CT systems.

In the following, further embodiments of the present invention are described referring in particular to an anode disk element for an X-ray generating device. However, these explanations also apply to the X-ray generating device, the X-ray system, the method of manufacturing an anode disk element and to the use of an anode disk element.

It is noted that arbitrary variations and interchanges of single or multiple features between claims and in particular claimed entities are conceivable and within the scope and disclosure of the present patent application.

According to a further exemplary embodiment of the present invention, the anode disk element may be provided as a composite material and/or a material comprising an anisotropic thermal conductivity.

In particular a composite material may allow for a manufacture of an anode disk element with specifically tailored mechanical and structural properties to withstand increased mechanical stress and thermal exposure while maintaining structural integrity.

According to a further exemplary embodiment of the present invention, the composite material may comprise a matrix structure being composed of at least one fiber material and at least one matrix material.

The use of a composite material may allow to specifically design or tailor the shape and in particular material properties of the anode disk element for a desired application.

Fiber materials as well as matrix materials may be any material like carbon material, ceramic material, polymer material or metal.

In the context of the present patent application it may be considered to be in particular beneficial to employ a carbon-based fiber material and a carbon-based or ceramic-based matrix material.

According to a further exemplary embodiment of the present invention, the composite material may comprise a polar configuration.

In particular, the fiber material, thus the alignment or weave of the fibers of the fiber material, may be aligned in a polar configuration. A polar configuration may also be described using polar coordinates, i.e. a distance from a point or axis and an angulation or angle. An according polar configuration may comprise true radial and circumferential fibers, describable by only one polar coordinate varying, like for example varying the distance from the rotational axis with regard to radially aligned fibers or varying the angulation regarding circumferentially aligned fibers, with the respective other variable remaining constant for that particular fiber.

According to a further exemplary embodiment of the present invention, the at least one heat dissipating element may be provided as a metal element in particular, as a refractory metal element or refractory metal fiber. A metal element, in particular made from a refractory metal, may provide efficient thermal conductivity or heat dissipation capacity for the transfer of heat between layers of a fiber structure.

According to a further exemplary embodiment of the present invention, the at least one heat dissipating element may be manufactured from a material out of the group consisting of refractory metal, tungsten, rhenium, niobium, molybdenum, tantalum and their respective alloys.

An according metal may constitute a material for providing a sufficient heat transfer path between fiber layers while tolerating and/or withstanding increased temperatures in the vicinity of the focal track, which may occur during a regular or also irregular mode of operation of the X-ray generating device.

According to a further exemplary embodiment of the present invention, the at least one heat dissipating element may be incorporated into the anode disk element by weaving and/or pinning.

Incorporating the at least one heat dissipating element by weaving or pinning may provide for an easy manufacture of an anode disk element, in particular provided as a pre-formed fiber structure, by adding the heat dissipating element in particular at a stage, in which the pre-form structure itself may be considered to be complete. Thus, the heat dissipating element may be incorporated substantially as a final step into the pre-form structure prior to, while or even briefly after adding matrix material.

Pinning may even be performed during or even after densification of the pre-form fiber element. The pre-form fiber structure, e.g. a carbon fiber structure, may be densified by a compression process, pyrolytic carbon impregnation or chemical vapor infiltration.

According to a further exemplary embodiment of the present invention, the heat dissipating element may be adapted for heat dissipation from the focal track in the direction of reduced thermal conductivity.

By providing a heat dissipating element, that provides a preferred, thus increased, thermal conductivity in a direction compared to the thermal conductivity of the anode disk element in that direction, heat dissipation in a certain direction of the anode disk element may be increased without altering the internal structure of the anode disk element. The heat conductive element may also be employed as a heat distribution element in a direction of reduced heat conductivity of the anode disk element.

According to a further exemplary embodiment of the present invention, the heat dissipating element may be adapted for heat dissipation from the focal track in axial direction.

An according heat dissipating element may provide a heat transfer path, in particular in the cross-ply or axial direction possibly crossing or bridging gaps or distances in the fiber structure of the anode disk element, in particular across different laminar layers not being in direct fiber to fiber contact with one another.

In the following, further embodiments of the present invention are described referring in particular to the method of manufacturing an anode disk element. However, these explanations also apply to the anode disk element, the X-ray generating device, the X-ray system and the use of an anode disk element in at least one of an X-ray generating device, an X-ray tube and an X-ray system.

According to a further exemplary embodiment of the present invention, the at least one heat dissipating element is incorporated into the anode disk element in the area of the focal track.

Providing the heat dissipating element or the heat conducting element in the area of the focal track allows for either simplified adding of the focal track by methods like chemical vapor deposition and vacuum plasma spraying or may make it even dispensable to add a separate, dedicated focal track, with the at least one heat dissipating element constituting the focal track itself. It is also conceivable to high temperature braze the focal track into place.

BRIEF DESCRIPTION OF THE DRAWINGS

These and other aspects of the present invention will become apparent from and elucidated with reference to the embodiments described hereinafter.

Exemplary embodiments of the present invention will be described below with reference to the following drawings.

The illustration in the drawings is schematic. In different drawings, similar or identical elements are provided with similar or identical reference numerals.

The figures are not drawn to scale, however may depict qualitative proportions.

Figure 1:
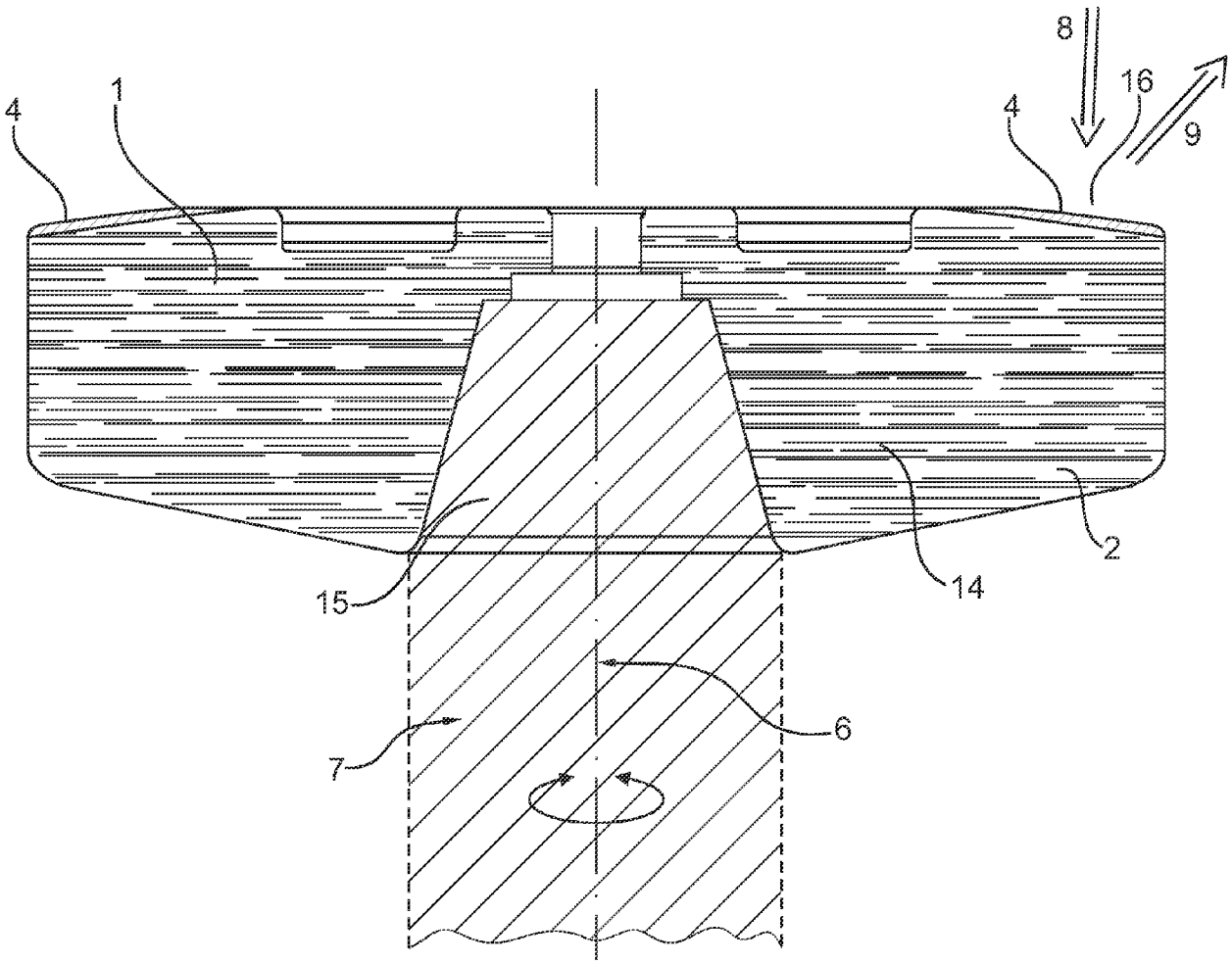
Figure 2A:
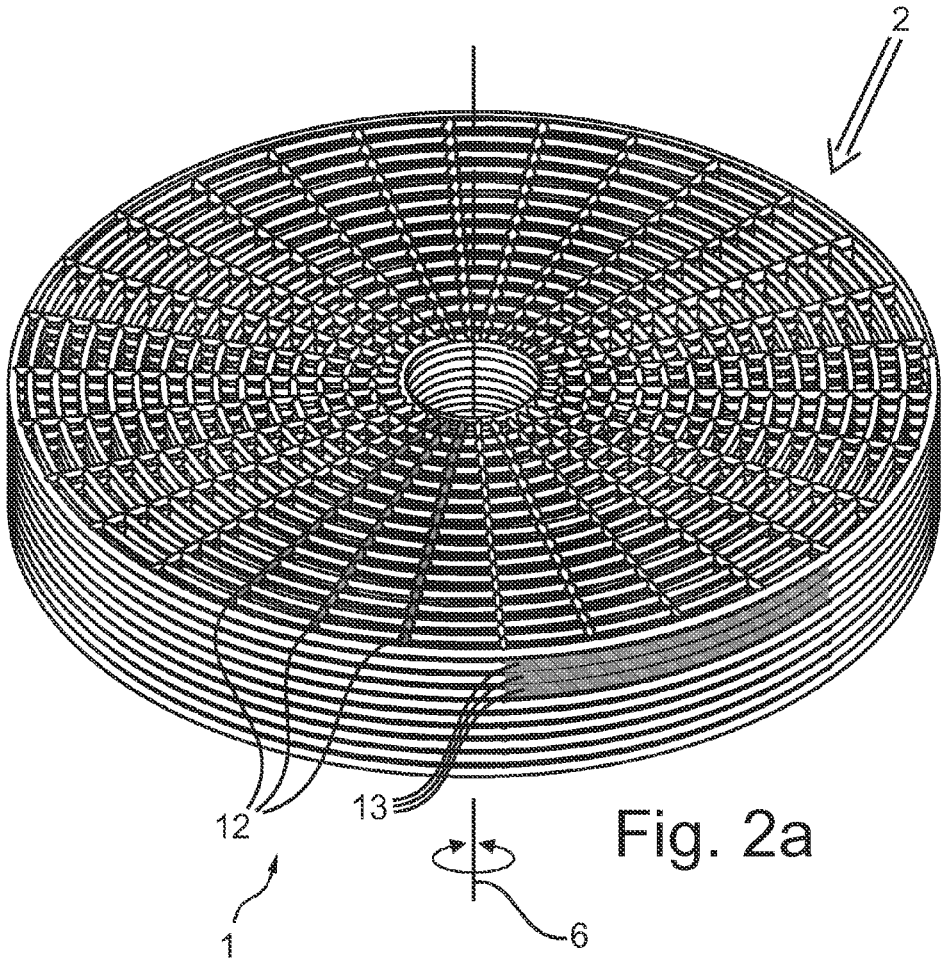
Figure 3A:
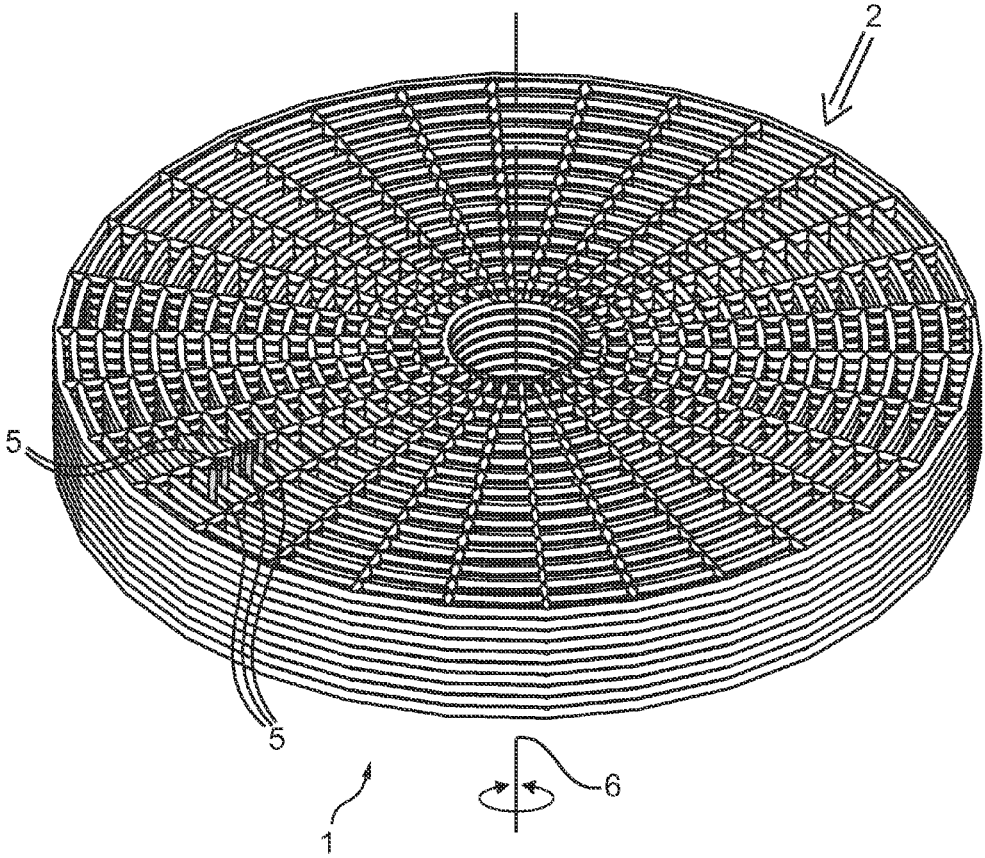
Figure 4A:
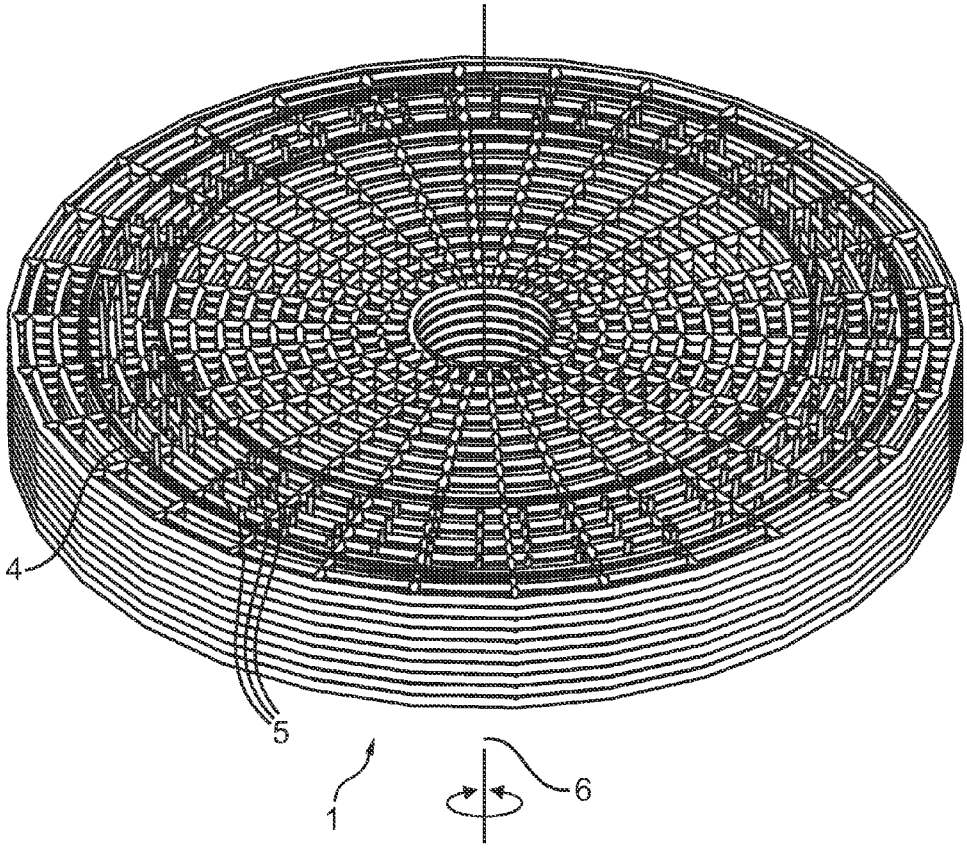
Figure 4B:
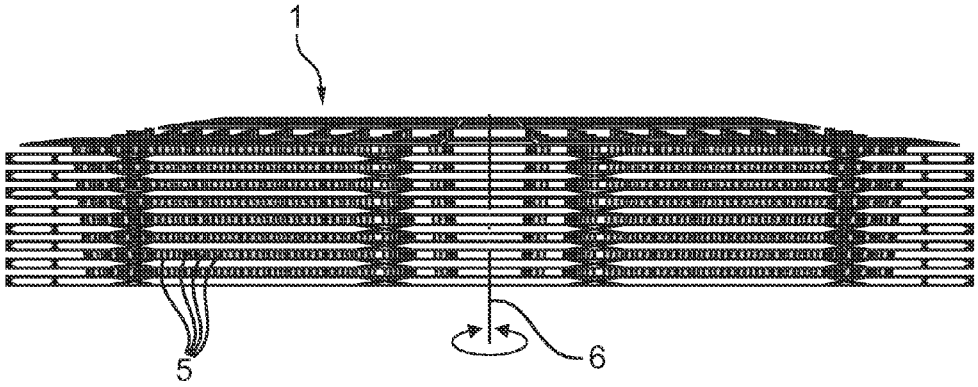
Figure 5:
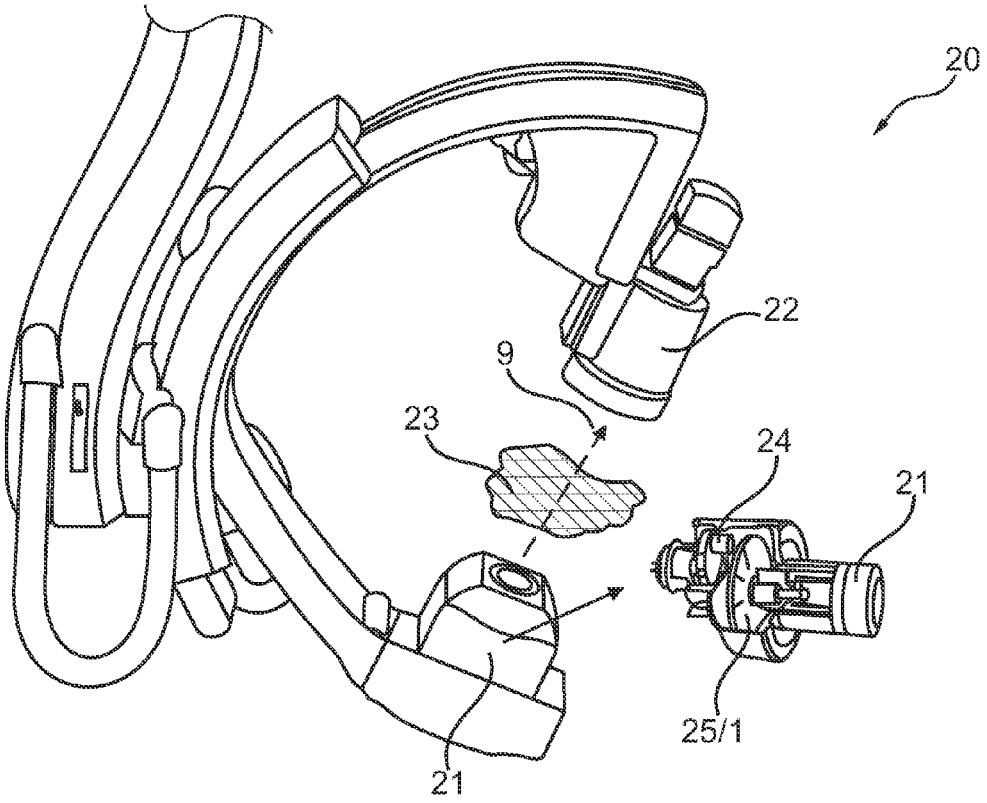
Figure 6:
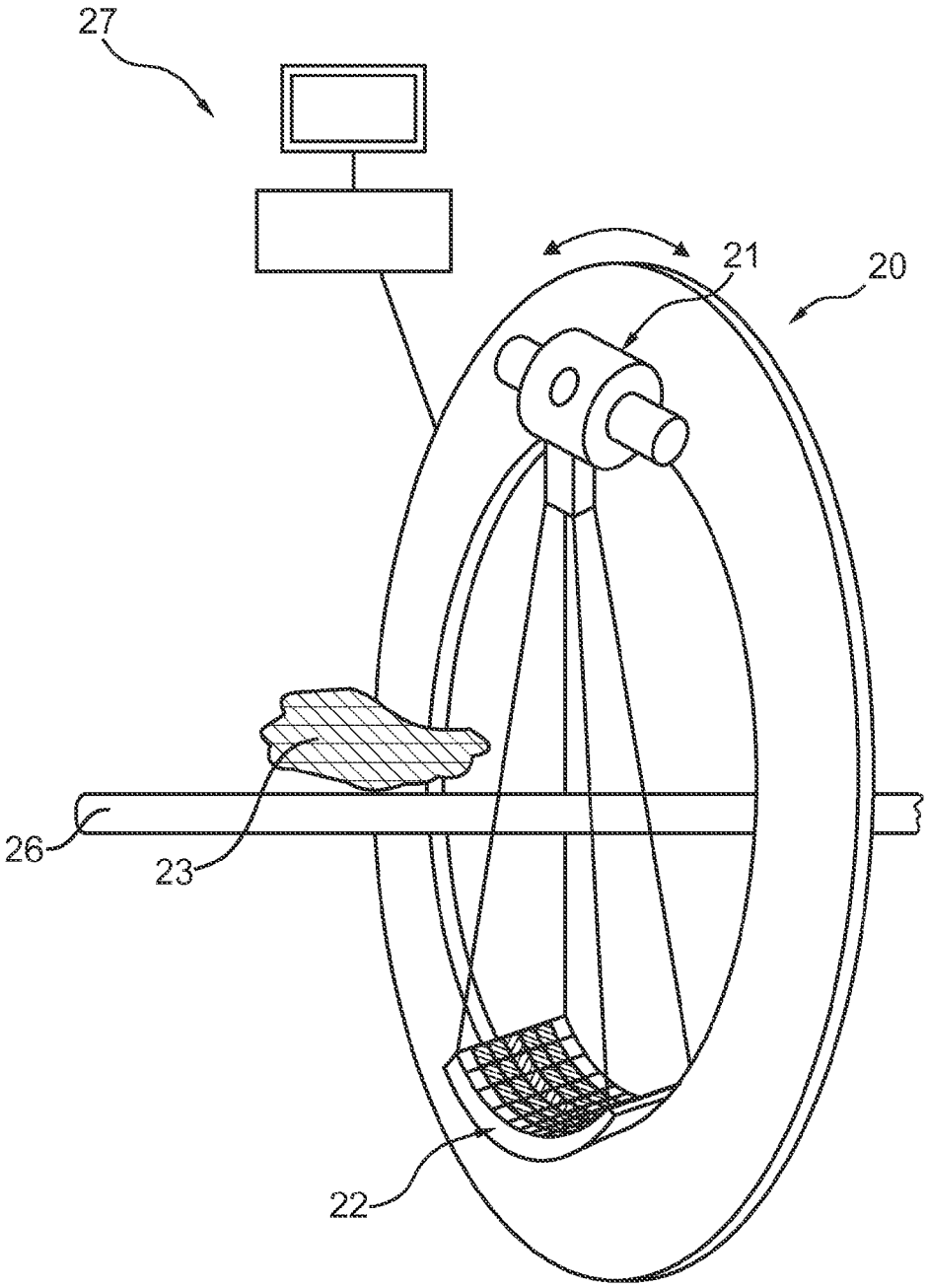
Figure 7:
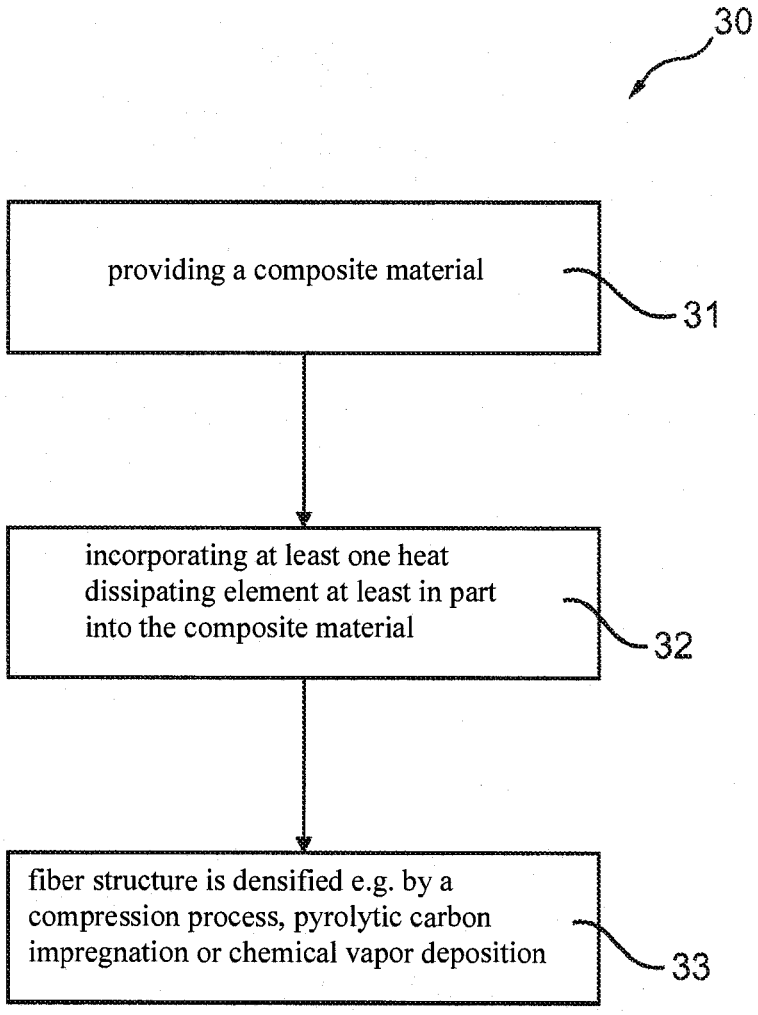
Figure 8A:
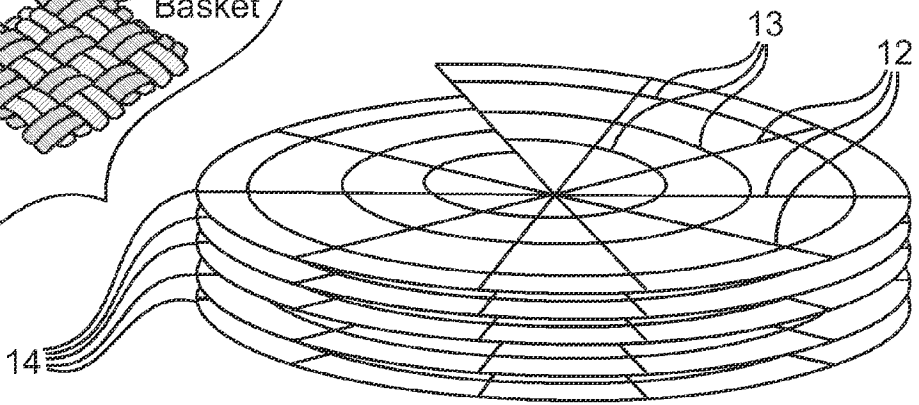
Figure 9A:
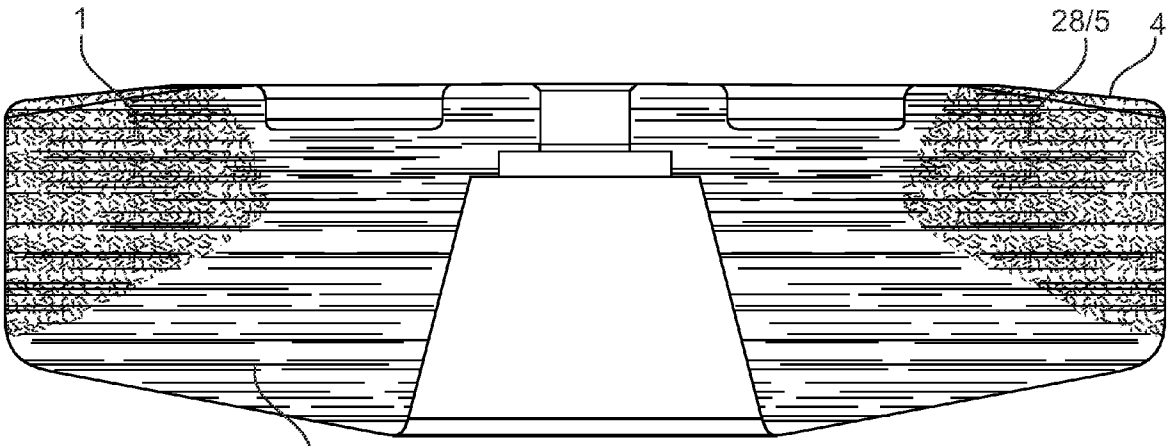

FIG. 1 shows an anode disk element of an X-ray generating device,

FIG. 2*a,b* show a polar configuration of an exemplary embodiment of a fiber structure according to the present invention, FIG. 3*a,b,c* show an exemplary embodiment of the incorporation of five heat dissipating elements into the fiber structure of FIG. 2*a,b*, FIG. 4*a,b* shows an exemplary embodiment of the incorporation of multiple heat dissipating elements in a fiber structure in the area of the focal track according to the present invention, FIG. 5 shows a first exemplary embodiment of an X-ray system according to the present invention, FIG. 6 shows a second exemplary embodiment of an X-ray system according to the present invention, FIG. 7 shows a flow-chart of an exemplary embodiment of the method of manufacturing an anode disk element according to the present invention, FIG. 8*a,b* show exemplary embodiments of weave architectures of an anode disk element according to the present invention, and FIG. 9*a,b* show exemplary embodiments of an anode disk element comprising a heat dissipating element as metal infusion according to the present invention.

DETAILED DESCRIPTION OF EMBODIMENTS

Now referring to FIG. 1, an exemplary embodiment of an anode disk element for an X-ray generating device is depicted.

The anode disk element 1 comprises a composite material 2, having individual fiber layers 14. In the centre of the anode disk element 1, a recess 15 is incorporated for the attachment of an axis element 7 for rotation of the anode disk element 1. Actuator elements, employed for rotating the anode disk element 1 are not depicted in FIG. 1. The axis element 7 is indicated by the dashed lines.

In FIG. 1, the individual fiber layers 14 are arranged substantially perpendicular to the rotation axis 6 and the axis element 7 respectively. The anode disk element 1 comprises a focal track 4, situated in FIG. 1 at the outer rim of the upper surface of the anode disk element 1. The focal track 4 is slightly inclined with regard to the upper surface of the anode disk element 1, which upper surface may in particular be substantially perpendicular to the rotation axis 6.

On the focal track 4, a focal spot 16 is arranged. The focal spot 16 is that area of the focal track 4 that is bombarded with electrons 8 for generation of X-radiation 9. The path of electron bombardment 8 and the path of generated X-radiation 9 is indicated with two arrows in FIG. 1.

Now referring to FIG. 2*a,b*, an exemplary embodiment of a polar configuration of an anode disk element according to the present invention is depicted.

Anode disk element 1 comprises a composite material structure 2 of which only the fiber structure is depicted in FIGS. 2*a* and *b*. The anode disk element 1 is composed by individual fiber layers 14 situated adjacent to each other without a direct fiber connection, possibly being spaced apart by the matrix material.

A polar configuration of the anode disk element 1 may be achieved by employing true radial fibers 12 combined with true circumferential fibers 13. The rotation axis 6 is indicated in both FIGS. 2*a* and 2*b*.

Figure 2B:
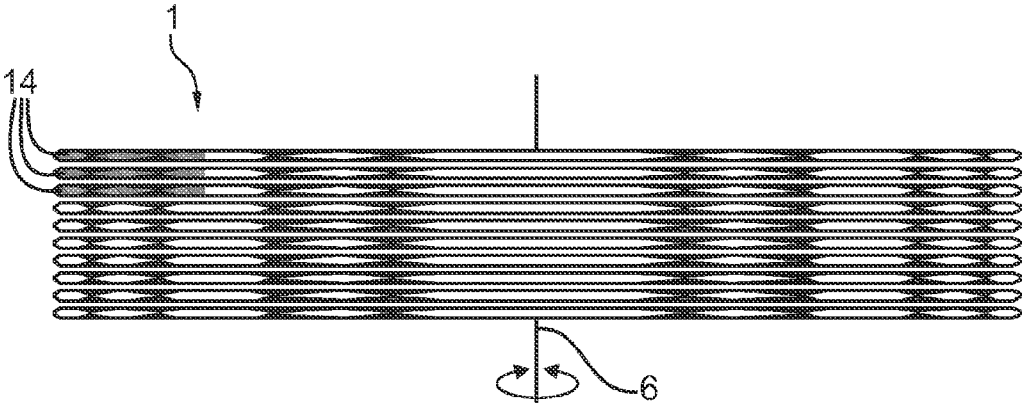

The distance or gaps between the individual fibers 12, 13, 14 in FIGS. 2*a* and 2*b* is only to illustrate the basic concept of a polar configuration of anode disk element 1. In particular, the fibers may be spaced apart with substantially smaller distances, thus arriving at a substantially uniform fiber layer 14.

Now referring to FIGS. 3*a,b,c*, an exemplary embodiment of the incorporation of five heat dissipating elements into the fiber structure of FIG. 2*a,b* is depicted.

Figure 3B:
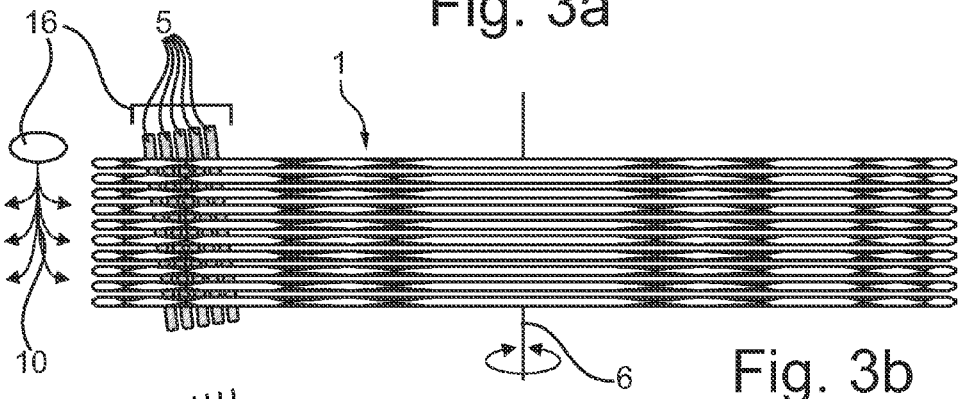

The individual fiber layers 14 are not connected by a fiber to fiber connection, thus an interlayer connection, as may be taken from FIG. 2*b*. An according fiber to fiber connection may be provided by employing, thus inserting or incorporating, heat dissipating elements 5 into the fiber structure of the anode disk element 1. In FIG. 3*b*, five elongated, pin-shaped or nail-shaped heat dissipating elements 5 are depicted, being incorporated into the fiber structure of anode disk element 1.

The heat dissipating elements 5 provide an interlaminar path for the conduction of heat, thus the distribution of heat via all fiber layers 14. In an example, a focal spot 16 situated at the top side of the heat dissipating elements 5 is heated, indicated by the arrow element 10 to the left of FIG. 3*b*. Heat is conducted downwards through the heat dissipating elements 5 and is distributed from the heat dissipating elements 5 into the fiber structure as depicted in FIG. 3*c*.

The heat dissipating elements 5 may be inserted into the gap structure of the composite material 2 of anode disk element 1, possibly touching or penetrating individual fibers 12, 13, providing an interlaminar connection between the fiber layers 14. It is also conceivable to employ fibers as heat conductive elements 5 penetrating fibers 12, 13 or being interweaved with fibers 12, 13, while still crossing fiber layers 14.

In case fibers are employed, the fibers may not need to have a substantially linear extension but may also be of a weaved structure possibly having a curved, bent or curly shape for an improved contact with the fiber elements 12, 13.

Figure 3C:
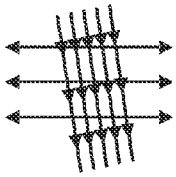

Heat conduction 10 is indicated in FIG. 3*c*. In this example, heat is conducted downwards and extends from the heat dissipating elements 5 outwards into the fiber structure, thus both to the outside and to the inside of the anode disk element 1.

Now referring to FIG. 4*a,b*, an exemplary embodiment of the incorporation of multiple heat dissipating elements in a fiber structure in the area of a focal track according to the present invention is depicted.

Heat dissipating elements 5 are incorporated into the fiber structure of anode disk element 1 substantially symmetrical with regard to the rotational axis 6. Anode disk element 1 may have heat conducting elements 5 incorporated substantially throughout the complete fiber structure or, as depicted in FIG. 4*a,b*, only in the area of a focal track 4. The heat dissipating elements 5 thus underlie the focal track area 4 to provide an improved heat dissipation or conduction of heat emanating from the focal track 4 between individual fiber layers 14. The heat dissipating elements 5 provide a preferred heat removal from the focal track 4 into the fiber structure to distantly arranged fiber layers 14. The heat conducting elements 5 may improve the incorporation of a focal track 4 or may even constitute the focal track 4 themselves.

Now referring to FIG. 5, a first exemplary embodiment of an X-ray system according to the present invention is depicted.

In FIG. 5 an exemplary X-ray system 20, a ceiling mounted C-arc system, is depicted. The C-arc comprises an X-ray generating device 21 and an X-ray detector 22. An object 23 is situated in the path of X-radiation 9 between the X-ray detector 22 and the X-ray generating device 21. The X-ray generating device 21 comprises a cathode element 24 and an anode element 25, which comprises an anode disk element 1.

Now referring to FIG. 6, a second exemplary embodiment of an X-ray system according to the present invention is depicted.

In FIG. 6, a CT X-ray system comprising an X-ray generating device 21 and an X-ray detector 22, is depicted. An object 23 is situated on a support 26 in the line of X-radiation between X-ray generating device 21 and X-ray detector 22. A control system 27 is provided for controlling parameters of an X-ray image acquisition protocol.

X-ray generating device 21 and X-ray detector 22 are arranged to be rotatable about the object 23, in particular a region of interest positioned at the isocenter between the X-ray generating device 21 and X-ray detector 22 for the generation of three-dimensional X-ray images, which may in particular be displayed as coronal, axial and sagittal sliced images.

Now referring to FIG. 7, a flow-chart of an exemplary embodiment of the method of manufacturing an anode disk element according to the present invention is depicted.

Method for manufacturing 30 an anode disk element comprises the step of providing 31 a composite material and incorporating 32 at least one heat dissipating element at least in part into the composite material. At a step 33, the fiber structure is densified e.g. by a compression process, pyrolytic carbon impregnation or chemical vapor deposition.

Now referring to FIGS. 8*a,b*, exemplary embodiments of weave architectures of an anode disk element according to the present invention are depicted.

FIG. 8*a* shows a simplified schematic illustration of the polar configuration of the anode disk element of FIG. 4*a,b*. The anode disk element is composed of individual fiber layers 14, each comprising radial fibers 12 and circumferential fibers 13.

Figure 8B:
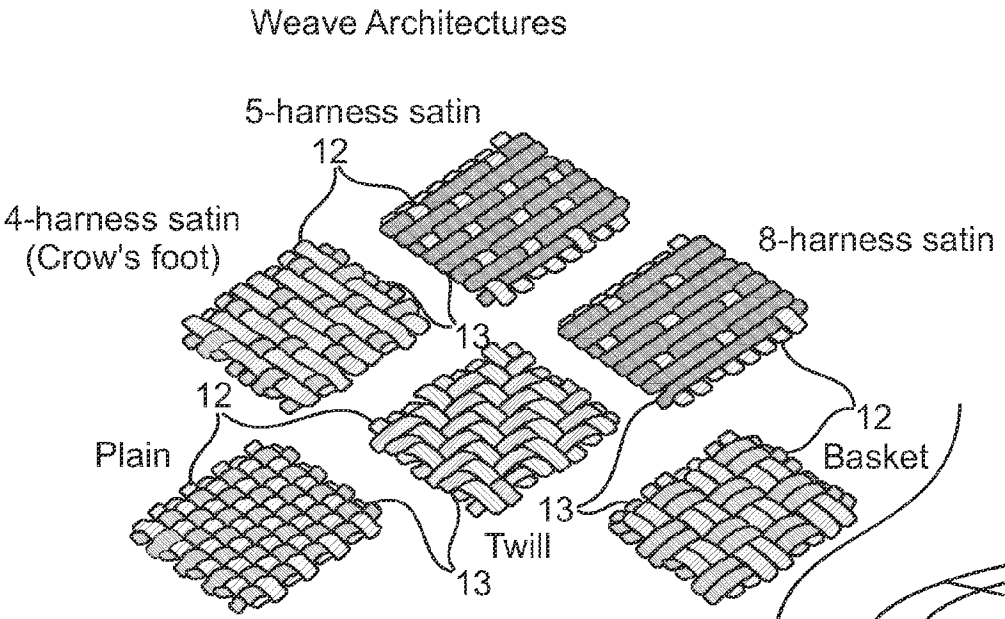

In FIG. 8*b*, individual weave pattern of the radial fibers 12 and the circumferential fibers 13 are depicted. Exemplary weave pattern or weave architectures may be plain weave, twill weave, basket weave, 4-harness satin (crow's foot) weave, 5-harness satin weave and 8-harness satin weave. Individual fiber layers 14 may comprise individual weave pattern.

As may be taken from FIG. 8*b*, at the respective point of intersection, radial fibers 12 and circumferential fibers 13 may be considered to be perpendicular relative to each other.

The weaving structure of radial fibers 12 and circumferential fibers 13 may also be exchanged to arrive at weave pattern, thus the pattern is rotated substantially about 90°.

Now referring to FIGS. 9*a,b*, exemplary embodiments of an anode disk element comprising a heat dissipating element as metal infusion according to the present invention are depicted.

FIG. 9*a* shows an exemplary embodiment of an anode disk element 1 having a carbon fiber reinforced carbon (CFC) polar weave structure with focal track 4 deposited and metal infusion 28 provided as a heat conducting element 5 under the focal track 4.

Figure 9B:
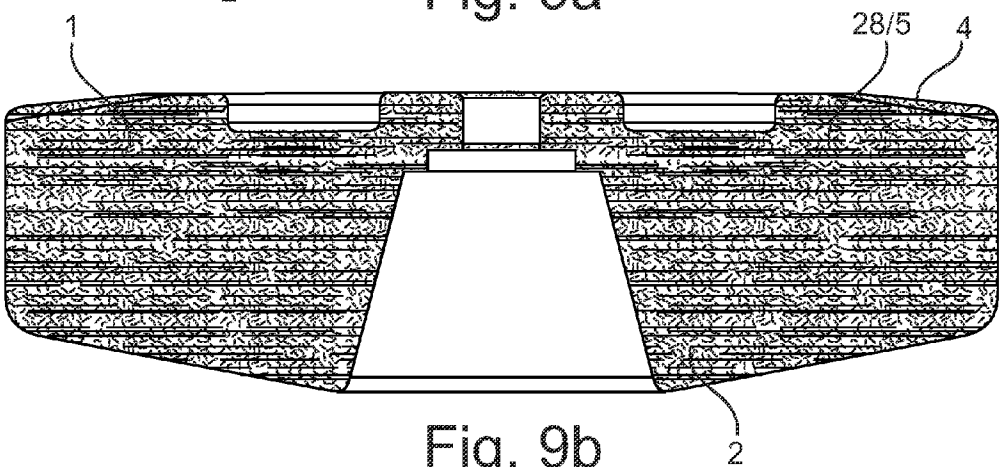

FIG. 9*b* shows an exemplary embodiment of an anode disk element 1 having a carbon fiber reinforced carbon (CFC) polar weave structure with focal track 4 deposited and metal infusion 28 provided as a heat conducting element 5 throughout the entire CFC substrate.

In FIGS. 9*a* and 9*b*, metal infusion 28 is provided for conducting heat away from the focal spot 16 of the focal track 4, in particular in a direction parallel to the rotational axis, since the anisotropic thermal conductivity of the anode disk element may be seen as being reduced in an axial direction. Thus, by employing the heat conducting element 5 as metal infusion 28, heat occurring at the focal spot 16 is distributed through at least a part of the anode disk element 1 by providing a translaminar heat dissipating path within the anode disk element 1.

In FIGS. 9*a* and 9*b*, metal infusion 28 is provided for conducting heat away from the focal spot 4, in particular in a direction parallel to the rotational axis, since the anisotropic thermal conductivity of the anode disk element may be seen as being reduced in an axial direction. Thus, by employing the heat conducting element 5 as metal infusion 28, heat occurring at the focal spot 4 is distributed through at least a part of the anode disk element 1 by providing a translaminar heat dissipating path within the anode disk element 1.

It should be noted that the term "comprising" does not exclude other elements or steps and that "a" or "an" does not exclude a plurality. Also, elements described in association with different embodiments may be combined.

It should also be noted, that reference numerals in the claims shall not be construed as limiting the scope of the claims.

REFERENCE NUMERALS

1 Anode disk element
2 Composite material
4 Focal track
5 Heat dissipating element
6 Rotation axis
7 Axis element
8 Path of electron bombardment
9 X-radiation
10 Heat conduction
12 Radial fiber
13 Circumferential fiber
14 Fiber layer
15 Recess
16 Focal spot
20 X-ray system
21 X-ray generating device
22 X-ray detector
23 Object
24 Cathode element
25 Anode element
26 Support
27 Control system
28 Metal infusion
30 Method of manufacturing an anode disk element
31 Step: Providing a composite material
32 Step: Incorporating at least one heat dissipating element
33 Step: Densifying fiber structure

The invention claimed is:

1. An anode disk element for an X-ray generating device, comprising:

a composite material having a plurality of individual fiber layers spaced apart from each other by matrix material such that fibers of a first layer of the plurality of individual fiber layers do not contact fibers of a second layer of the plurality of individual fiber layers formed over the first layer;

a focal track located at a portion of the anode disk element; and heat dissipating elements comprising a metal and connecting the first layer to the second layer throughout the composite material including at position under the focal track and further positions not under the focal track, wherein the anode disk element is rotatable about a rotational axis, wherein the focal track is rotationally symmetrical to the rotational axis, wherein the anode disk element comprises an anisotropic thermal conductivity, and wherein the heat dissipating elements are configured to dissipate heat from the focal track in the direction of reduced thermal conductivity of the anode disk element.

2. The anode disk element according to claim 1, wherein the composite material comprises a polar configuration.

3. The anode disk element according to claim 1, wherein the heat dissipating elements are provided as an elongated element including a refractory metal fiber.

4. The anode disk element according to claim 1, wherein the at least one heat dissipating elements are manufactured from a material out of the group consisting of refractory metal, tungsten, rhenium, niobium, molybdenum, tantalum and their respective alloys.

5. The anode disk element according to claim 1, wherein the heat dissipating elements are incorporated into the anode disk element by at least one of weaving and pinning.

6. The anode disk element according to claim 1, wherein the heat dissipating elements are incorporated into the anode disk element by metal infusion.

7. An X-ray generating device, comprising:

a cathode element; and an anode element, wherein the cathode element and the anode element are operatively coupled for generation of X-rays, and wherein the anode element comprises an anode disk element, the anode disk element comprising:

a composite material having a plurality of individual fiber layers spaced apart from each other by matrix material such that fibers of a first layer of the plurality of individual fiber layers do not contact fibers of a second layer of the plurality of individual fiber layers formed over the first layer;

a focal track located at a portion of the anode disk element; and heat dissipating elements comprising a metal and connecting the first layer to the second layer throughout the composite material including at position under the focal track and further positions not under the focal track.

8. An X-ray system, comprising an X-ray generating device; and an X-ray detector, wherein an object is arrangeably between the X-ray generating device and the X-ray detector, wherein the x-ray generating device and the X-ray detector are operatively coupled such that an X-ray image of the object is obtainable, and wherein the X-ray generating device is provided as an X-ray generating device, the X-ray generating device, comprising:

a cathode element; and an anode element, wherein the cathode element and the anode element are operatively coupled for generation of X-rays, and wherein the anode element comprises an anode disk element, the anode disk element comprising:

a composite material having a plurality of individual fiber layers spaced apart from each other by matrix material such that fibers of a first layer of the plurality of individual fiber layers do not contact fibers of a second layer of the plurality of individual fiber layers formed over the first layer;

a focal track located at a portion of the anode disk element; and heat dissipating elements comprising a metal and connecting the first layer to the second layer throughout the composite material including at position under the focal track and further positions not under the focal track.

9. A method of manufacturing an anode disk element, comprising the acts of:

a composite material having a plurality of individual fiber layers spaced apart from each other by matrix material such that fibers of a first layer of the plurality of individual fiber layers do not contact fibers of a second layer of the plurality of individual fiber layers formed over the first layer;

providing a focal track located at a portion of the anode disk element; and incorporating heat dissipating elements into the anode disk element, wherein the heat dissipating elements are configured for heat dissipation from a focal track in the direction of reduced thermal conductivity of the anode disk element, and wherein the heat dissipating elements comprise a metal and connect the first layer to the second layer throughout the composite material including at position under the focal track and further positions not under the focal track.

10. The method according to claim 9, wherein the heat dissipating elements are elongated elements and are incorporated into the anode disk element by at least one of weaving pinning, and metal infusion.

11. The anode disk element of claim 1, wherein the plurality of individual fiber layers is perpendicular to the rotational axis.

12. The anode disk element of claim 1, wherein the plurality of individual fiber layers includes circumferential fibers and radial fibers extending from the circumferential fibers towards the rotational axis.

* * * * *